US005528226A

United States Patent [19]

Brown et al.

[11] Patent Number: 5,528,226

[45] Date of Patent: Jun. 18, 1996

[54] APPARATUS AND METHOD FOR CONTROLLING THE BURN-OFF OPERATION OF A GAS IN A SEMICONDUCTOR WAFER FABRICATION FURNACE

[75] Inventors: William R. Brown, Round Rock; Dennis C. Swartz, Buda; Donald L. Friede, Austin, all of Tex.

[73] Assignee: Advanced Micro Devices Inc., Sunnyvale, Calif.

[21] Appl. No.: 265,038

[22] Filed: Jun. 24, 1994

[51] Int. Cl.[6] ..... G08B 21/00

[52] U.S. Cl. ..... 340/664; 340/635; 431/66; 219/263; 219/264

[58] Field of Search ..... 340/634, 635, 340/664, 584; 374/142, 149; 431/16, 66; 437/7; 237/2 A, 12.1, 12.3 C; 137/65; 219/263, 264

[56] References Cited

U.S. PATENT DOCUMENTS 3,594,107 7/1971 Willson ..... 431/66

4,788,529 11/1988 Lin ..... 340/632

5,035,607 7/1991 Peterson ..... 431/46

*Primary Examiner*—John K. Peng

*Assistant Examiner*—Julie Lieu

*Attorney, Agent, or Firm*—Foley & Lardner

[57] ABSTRACT

An apparatus and method for monitoring temperature and current in a gas ignition chamber by monitoring temperature in the gas ignition chamber, monitoring current flowing through first and second ignitors housed in the gas ignition chamber, comparing the temperature of the gas ignition chamber to a predetermined temperature, comparing the current flowing through the first ignitor to a first predetermined current, comparing the current flowing through the second ignitor to a second predetermined current, inactivating the first ignitor and activating the second ignitor whenever the current through the first ignitor becomes less than the first predetermined current, and sounding an audible alarm whenever the current through said second ignitor becomes less than the second predetermined current or whenever the temperature is below the predetermined temperature.

4 Claims, 4 Drawing Sheets

APPARATUS AND METHOD FOR CONTROLLING THE BURN-OFF OPERATION OF A GAS IN A SEMICONDUCTOR WAFER FABRICATION FURNACE

BACKGROUND OF THE INVENTION

The present invention generally relates to an apparatus for controlling the burn-off operation of a gas in a furnace used for fabricating semiconductor wafers and, more particularly, is concerned with an apparatus and method for controlling the current supplied to the ignitors and monitoring the temperature of the ignitors during the burn-off operation of hydrogen gas in the furnace. Known systems for such burn-off operations have a high failure rate and are complex and expensive. In one known system, a voltage sensor is used for monitoring the current of the ignitor which is not reliable. In addition, known systems do not provide a display of the burn-off temperature, thereby making it difficult to monitor the gas burn-off temperature for the purpose of trouble-shooting when a failure occurs.

SUMMARY OF THE INVENTION

An object of the invention is to improve the reliability of the burn-off operation.

Another object is to provide an opportunity for proactive replacement of elements of the apparatus based upon their heat output instead of waiting for a failure to occur.

Still another object is to provide a versatile system which can be used to meet the combustion conditions of gases other than hydrogen.

Accordingly, the present invention relates to an apparatus and method for controlling the current supplied to the ignitors and monitoring the temperature of the ignitors during the burn-off operation of hydrogen gas in a semiconductor fabrication furnace by (a) monitoring the temperature in the gas ignition chamber; (b) monitoring current flowing through first and second ignitors housed in the gas ignition chamber; (c) comparing the temperature of the gas ignition chamber to a predetermined temperature; (d) comparing the current flowing through the first ignitor to a first predetermined current; (e) comparing the current flowing through the second ignitor to a second predetermined current; (f) inactivating the first ignitor and activating the second ignitor whenever the current through the first ignitor becomes less than the first predetermined current; and (g) sounding an audible alarm Whenever the current through the second ignitor becomes less than the second predetermined current or when the temperature becomes less than the predetermined temperature.

Additional objects, advantages and novel features of the invention will be set forth in the description which follows, and in part will become apparent to those skilled in the art upon examination of the following or may be learned by practice of the invention.

DETAILED DESCRIPTION OF THE PREFERRED EMBODIMENT

To facilitate a full and complete understanding of the invention, the environment in which the apparatus for controlling the burn-off operation of a gas according to the present invention operates will be reviewed first.

Figure 1:
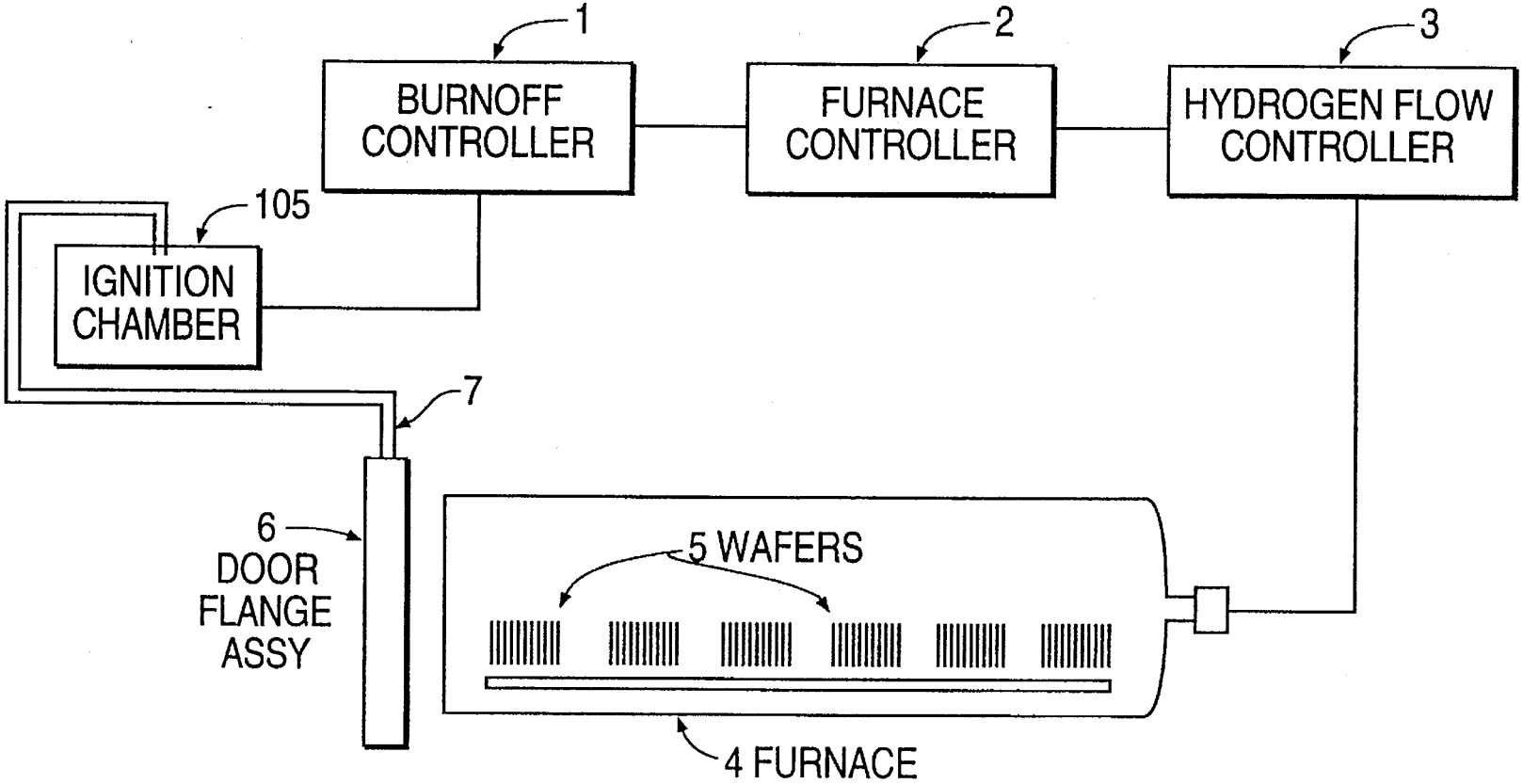
FIG. 1 is a schematic diagram of a semiconductor wafer fabrication burn-off operation employing the apparatus for controlling the burn-off operation according to the present invention.
Figure 2:
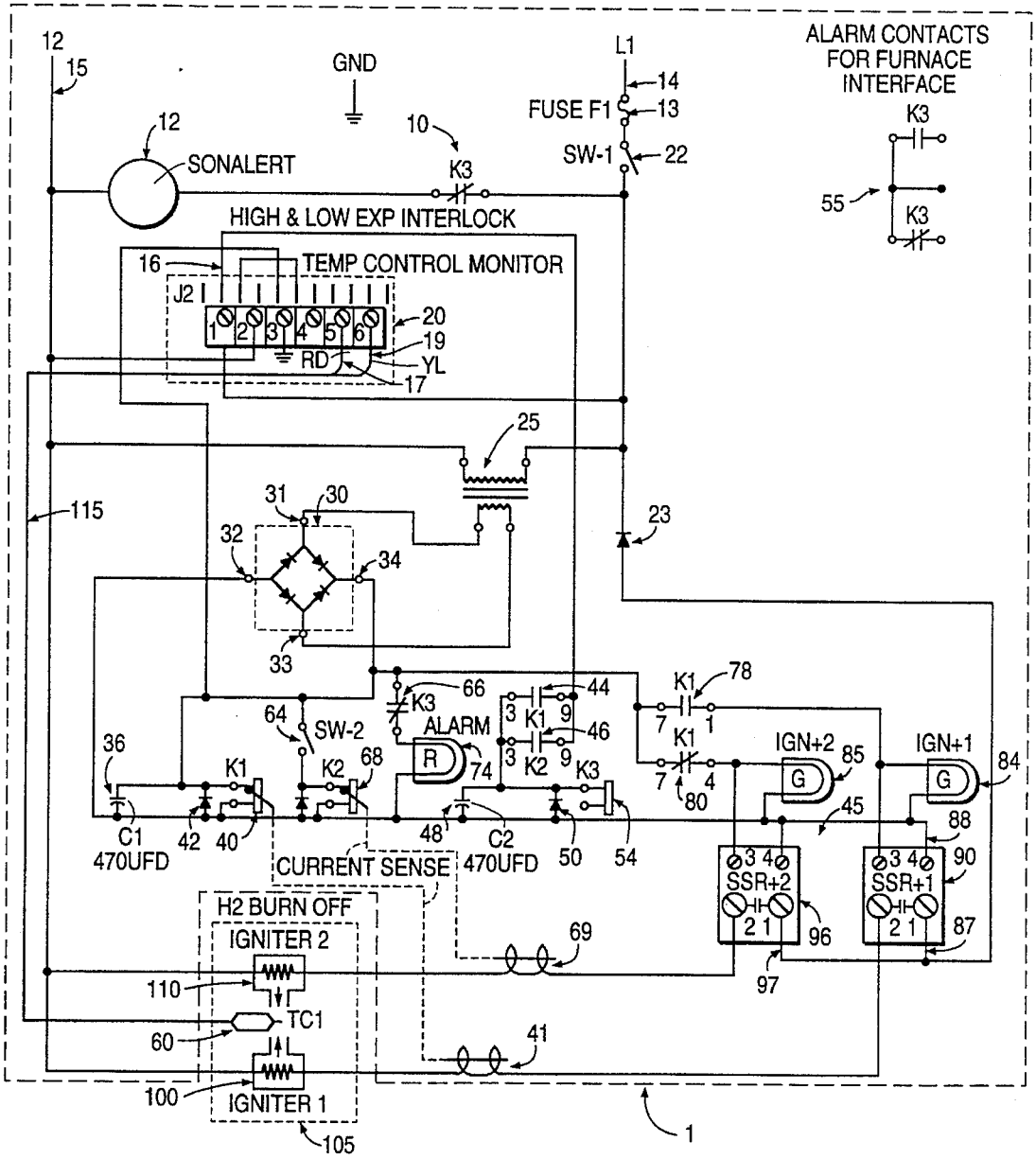
FIG. 2 is a circuit diagram of the apparatus for controlling the burn-off operation according to the present invention.
Figure 3:
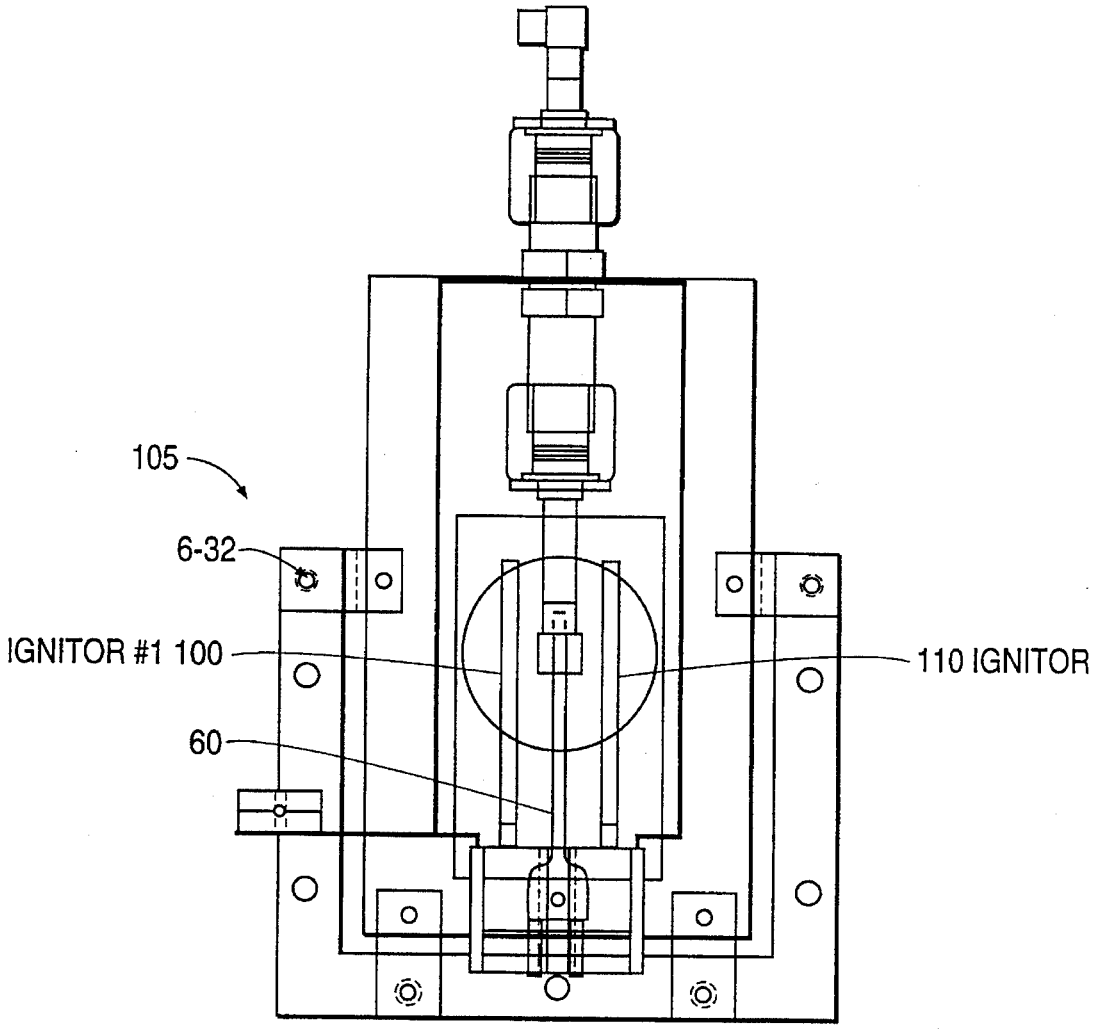
FIG. 3 represents an ignitor chamber according to the present invention.

Referring to FIG. 1, in a burn-off Operation, semiconductor wafers 5 are loaded into an alloy furnace 4 having a door flange assembly 6 which closes and seals the wafers 5 in the furnace 4. Attached to the door flange 6 is a delivery pipe 7 which is connected to an ignition chamber 105 (FIGS. 2 and 3). An apparatus for controlling the burn-off operation (burn-off controller) 1 is connected to the ignition chamber 105. The burn-off controller 1 is connected to a furnace controller 2 and the furnace controller 2 is connected to a hydrogen flow controller 3. The furnace controller 2 receives burn-off information from the burn-off controller 1 and determines whether the hydrogen flow controller 3 should be interrupted to control the flow of hydrogen in the furnace 4.

More particularly, the furnace controller 2 controls the hydrogen flow controller 3 to introduce hydrogen into the furnace 4. Hydrogen gas flows across wafers 5, then through the pipe 7 and into the ignition chamber 105 where the gas is burned. The burn-off controller 1 controls the current supplied to the ignition chamber 105 and monitors the temperature in the ignition chamber 105 during the burn-off operation of the hydrogen gas in the furnace 4.

A preferred embodiment of the apparatus and method for controlling the burn-off operation of the gas in the furnace is illustrated in FIG. 2 and generally designated 1 (apparatus enclosed by the dotted line). FIG. 2 shows the burn-off controller 1 connected to the ignition chamber 105. FIG. 3 is a detailed illustration of the ignition chamber 105. The burn-off controller 1 includes a 120 volts A.C. power supply (not shown) connected to alarm contacts 10 (normally closed), a temperature control monitor 20 (for example, an Omegarometer DP2001X, manufactured by Omega), a 24 volt AC step down transformer 25 (for example a Signal Transformer, DP-241-7-20, manufactured by Signal Transformer, connected to a main power switch 22 and a neutral line 15. The alarm contacts 10 is also connected to an audible alarm (sonalert) 12 which in turn is connected to the neutral line 15. With a voltage of 120 volts, the sonalert 12 is activated through contacts 10 and remains "on" until contacts 10 open.

As seen in FIG. 2, the step down transformer 25, a full wave bridge rectifier 30 (for example, a GBPC 3501, manufactured by General Instruments) and a capacitor 36 (470 uF) form a low voltage supply circuit 26 (28 VDC). The output of transformer 25 is connected to the AC inputs 31, 33 of bridge rectifier 30. The capacitor 36 is connected to the positive lead 34 of bridge rectifier 30 and the negative lead of capacitor 36 is connected to the negative lead 32 of bridge rectifier 30.

The temperature control monitor 20 is also connected to a current sense relay 40 (for example, SDAS-32 0107Y2S1024 manufactured by Potter & Brumfield) and a diode 42. The positive lead 34 of the bridge rectifier 10 is connected to the "LO TMP" relay contacts 16 of the temperature control monitor 20. The current sense relay coil 40 and diode 42 are also connected to the positive lead 34 of the bridge rectifier 30. The anode of diode 42 is connected to a 28 VDC common 45 and the cathode of diode 42 is connected to lead 34 (28 VDC). Diode 42 is used for reducing damaging Electromotive force (EMF) voltages. The current sense relay 40 is connected in parallel to the diode 42. As a result, when A.C. power is applied to the burn-off controller 1, the current sense relay 40 is energized. The output of the "LO TMP" relay contacts 16 is connected to contacts 44 and contacts 46 in parallel. A holding capacitor 48, an EMF diode 50 and a relay coil 54 are connected in a parallel manner to contacts 44 and 46. The 28 VDC common 45 is also connected to a capacitor 48, a diode 50 and a relay coil 54. The anode of diode 50 is connected to the 28 VDC common 45.

Specifically, when A.C. power is applied to the burn-off controller 1, relay 40 is energized thereby closing contacts 44 such the current conducts through the contacts 44 and through the temperature control monitor "LO TMP" contacts 16 when a thermocouple 60 is at a predetermined correct temperature, for example 85 degrees centigrade, thereby applying the 28 VDC voltage to the coil 54.

It will observed in FIG. 2 that the 28 VDC voltage supplied from the bridge rectifier 30 is also connected to a switch 64 and a relay contacts 66 (normally closed). Switch 64 is also connected to current sense relay 68 and an EMF diode 70 which in turn are connected to the 28 VDC common 45. The orientation of diode 70 is such that the anode of diode 70 is connected to the lead 34. Switch 64 is left open to prevent an accidental powering of relay 68. Once relay 40 is energized, switch 64 is manually closed and relay 68 is energized. Relay contacts 66 is also connected to a red indicator lamp 74, which in turn, is connected to the 28 VDC common 45. When A.C. power is applied to the burn-off controller 1, the red indicator lamp 74 turns on and remains on until contacts 66 open.

The 28 VDC from the bridge rectifier 30 is also connected to relay contacts 78 and 80. With relay 40 de-energized, contacts 78 are open and contacts 80 are closed. Connected to contacts 78 is a green indicator lamp 84 and the positive terminal 86 of SSR 90. The negative terminal 88 of SSR 90 and the other terminal of lamp 84 are connected to the 28 VDC common 45. In like manner, contacts 80 is connected to a green indicator lamp 85 and a SSR 96. The lamp 85 and SSR 96 also complete the circuit with connections to the 28 VDC common 45. As an example of SSRs 90 and 96, GA5-2D25 manufactured by Gordos may be used.

Referring back again to main power switch 22, a half wave rectifier 23 is connected to the switch 22. The anode of rectifier 23 is connected to SSR 90 and SSR 96 at inputs 87 and 97 respectively. When A.C. current is applied to the burn-off controller 1 and switch 22 is closed, a voltage of 120 VAC is applied to the half wave rectifier 23 and stepped down to a voltage which is equal to approximately 70 VAC as applied to SSRs 90 and 96. The output from SSR 90 passes through a current sense loop 41 of a current sense relay 40 and is connected to a first ignitor 100. In like manner, the output from SSR 96 passes through a current sense loop 69 of the current sense relay 68 and is connected to a second ignitor 110. The reduced voltage of 70 VAC is provided from rectifier 23 to extend the life of the ignitors 100, 110. As an example of ignitors 100, 110, Part # 279311 manufactured BY Factory Specific Parts may be used.

The alarm relay 54 has one set of contact closures 55, one of which is normally open and the other of which is normally closed, to interface with the furnace controller 2 to send a shut down signal to the furnace controller 2 which operates the hydrogen flow controller 3 (FIG. 1).

In operation, referring now to FIG. 2, current is supplied to the A.C. neutral line 15 and the A.C. line 14. Switches 22 and 64 are initially in the open position. The current passes through a fuse 13 and is applied to switch 22. When switch 22 is actuated (closed), the current passes through the switch 22 and across normally closed contacts 10 through the Sonalert alarm 12 to produce an audible alarm. The current also travels from the closed switch 22 through the temperature control monitor 20 to line 15. This provides a digital display of the temperature as recorded by the thermocouple 60 which connects to monitor 20 through terminal connections 17 and 19. The current travels from switch 22 through the half-wave rectifier 23 to the A.C. inputs 87, 97 of SSRs 90 and 96 respectively. The current also travels from the closed switch 22 to the step down transformer 25.

The output from transformer 25 is provided to the A.C. inputs 31, 33 of bridge rectifier 30. With capacitor 36 across the D.C. outputs 32, 34 of bridge rectifier 30, the voltage produced is equal to 28 V.D.C. The 28 V.D.C. voltage is supplied to the LO TMP alarm contacts 16 on the temperature control monitor 20. From the bridge rectifier 30, a 28 V.D.C voltage is also supplied to the coil of current sense relay 40. With relay 40 energized, contacts 44, 78, and 80 change state. The 28 V.D.C. voltage is supplied from rectifier 30 through contact 78 (which is now closed) to activate SSR 90. Lamp 84 is turned ON at this time. With SSR 90 activated, a path for the A.C. current is provided through the current sense loop 41 of relay 40, to the first ignitor 100 and the first ignitor 100 heats up.

As shown in FIG. 3, thermocouple 60 is provided to monitor the temperature of an ignition chamber 105, which includes the ignitors 100 and 110. Referring to Figure 2, the thermocouple 60 sends a temperature signal 115 to the temperature control monitor 20. The temperature control monitor 20 compares the temperature of the ignition chamber 105 to the LO TMP setpoint, for example, a setpoint of 78 degrees centigrade. When the temperature exceeds the LO TMP setpoint, the LO TMP contacts 16 close and allow the 28 V.D.C. voltage to be applied to contact 44 to energize alarm relay 54. When alarm relay 54 energizes, contacts 10 and 66 change state, thus breaking the current path to the Sonalert 12 and the red alarm lamp 74. The controller interface set of contacts 55 also change state at this time. Switch 64 is then closed allowing the 28 V.D.C. voltage to energize the current sense relay 68. The circuit activity does not change at this time, since there is no current in the current sense loop 69.

When the first ignitor 100 fails, the following operations are performed. The current sense loop 41 shows a loss of current. If the current is less than the setpoint of current sense relay 40, for example a setpoint of 1.0 amp., the relay 40 will de-energize. Also, contacts 44, 78 and 80 will change state. When contact 78 changes state, the 28 V.D.C. voltage is removed from SSR 90 and lamp 84. With no D.C. input voltage, SSR 90 breaks the A.C. current path to the first ignitor 100. When contact 80 changes state, the 28 V.D.C. voltage is supplied to SSR 96. SSR 96 then conducts the A.C. current through current sense loop 69 and the second ignitor 110. The second ignitor 110 heats up. When contact 44 changes state, capacitor 48 discharges to maintain the coil voltage of alarm relay 54, while current sense relay contact 46 closes and continues to maintain a 28 V.D.C. current path from the LO TMP contacts 16 to alarm relay 54.

When the second ignitor 110 fails, the current sense loop 69 shows a loss of current. If the current is less than the setpoint of current sense relay 68, for example a setpoint of 1.0 amp., relay 68 changes state. When relay 68 changes state, contact 46 opens and breaks the 28 V.D.C. current path to alarm relay 54. Capacitor 48 discharges; and when the voltage drops off, alarm relay 54 de-energizes. Also, contacts 10, 66 and 55 will change state. Contact 10 closes and provides a circuit path to turn on the Sonalert 12 sounding an audible alarm. Contact 66 closes and provides 28 V.D.C. voltage supply to turn ON the red alarm lamp 74. Contact 55 changes state to interface with the furnace controller to shut down the supply of combustible gas.

According to the present invention, if the sensed temperature of the ignition chamber 105 drops below the temperature value set in the LO TMP setpoint, the LO TMP contacts 16 change state. Consequently, the 28 V.D.C. voltage is removed from the coil path of alarm relay 54. Capacitor 48 discharges; and when the voltage drops off, alarm relay 54 de-energizes. Contacts 10, 66 and 55 change state. Contact 10 closes and provides a circuit path to turn ON the Sonalert 12 sounding an audible alarm. Contact 66 closes and provides a 28 V.D.C. voltage supply to turn ON the red alarm lamp 74. Contact 55 changes state to interface with the furnace controller to shut down the supply of the combustible gas.

Figure 4:
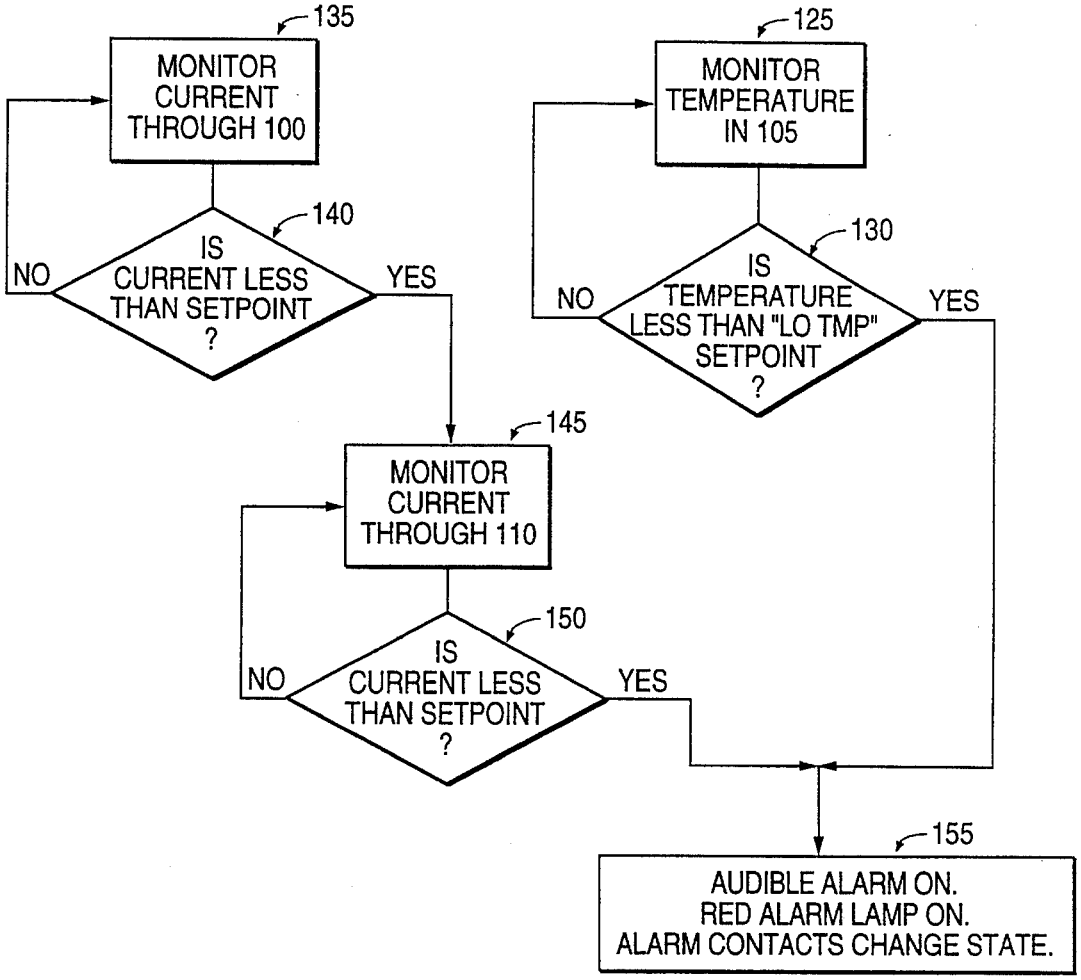
FIG. 4 is a flow chart representation of the burn-off operation control method according to the present invention.

Referring to FIG. 4, the method for monitoring temperature and current in the ignition chamber 105 includes a step 125 of monitoring temperature in the ignition chamber 105; a step 130 of comparing the temperature of the ignition chamber 130 to a predetermined temperature; a step 135 of monitoring the currant flowing through the first ignitor 100; a step 140 of comparing the current flowing through the first ignitor 100 to a first predetermined current; a step 145 of monitoring the current flowing through the second ignitor 110; a step 150 of comparing the current flowing through the second ignitor 110 to a second predetermined current; and a step 155 of sounding an audible alarm whenever in step 150 the current through the second ignitor 110 becomes less than the second predetermined current or whenever in step 130 the temperature becomes less than the predetermined temperature.

To summarize, the present invention provides a safe means with a backup protection to burn off combustible gases while providing long term diagnostic capabilities utilizing the temperature control monitor. Furthermore, the controller has a simple design allowing for a high mean time between failures rate and quick repair cycle in the event of failure. The present invention provides the current to ignition elements (ignitors) and monitors their temperature and current for the safe burn-off of excess Hydrogen from a furnace process. The present system embodies a unique combination of current sense relays and a temperature process monitor to ensure that the ignitor temperature is hot enough for the controlled ignition of the excess Hydrogen gas. In addition to the safety aspects, the controller utilizes a simple design with few major components and is more reliable than known burn-off control devices.

With the present invention, the following advantages are obtained:

a) The temperature control monitor provides a visual display of the LO TMP alarm setpoints and provides easy adjustment of the alarm setpoints to accommodate combustible gases other than hydrogen.

b) The temperature control monitor display allows periodic monitoring of the ignition chamber, thereby providing an opportunity for proactive replacement of elements based upon their heat output instead of waiting for a failure.

c) The temperature control monitor has a wide temperature display window, thus allowing for the display of ambient ignition temperature and the temperature of the burning gas. The ability to monitor the gas burn-off temperature makes the present invention a tool in trouble-shooting, where for example, a higher than normal burn-off temperature may indicate there is a leaking or drifting mass flow meter/controller.

d) Monitoring the current of the ignitor provides a true representation of a completed circuit with current flowing through the circuit. Any open device, which is the typical failure mode of ignitors or elements, will stop the current flow and would be sensed by the current sense relay.

e) Utilizing current sense relays with an adjustable potentiometer for the current sense trip points, allows the use of different types of ignitors or heating elements to meet the combustion conditions of gases other than hydrogen.

f) The simple circuit reduces the occurrence of controller breakdown and the use of readily available industry standard parts allows for fast repair should a failure occur.

g) The present invention monitors and detects two different types of failures: temperature failure and current failure, thus providing a reliable failure monitoring and detection system.

h) The present invention provides a normally open contact closure and a normally closed contact scheme to interface with a variety of controllers which govern gas flows.

i) The present system uses a redundant circuit (SSR-Current sense relay-Ignitor) which reduces complexity and cost in purchasing and maintenance of spare parts.

While this invention has been described in detail and with reference to the preferred embodiment thereof, it will be apparent to one skilled in the art that various changes and modifications can be made therein without departing from the spirit and scope thereof. The present invention is only limited by the claims appended hereto.

We claim:

1. An apparatus for controlling the burn-off operation of a gas in a semiconductor wafer fabrication furnace, comprising:

(a) means for providing current to a first igniting means provided in an ignition chamber;

(b) a first current sense relay for monitoring flow of the current through said first igniting means;

(c) means, which is comprised of a thermocouple and a temperature control monitor, for monitoring temperature of said ignition chamber and comparing the temperature of the ignition chamber to a predetermined temperature to provide a temperature signal indicative thereof when the temperature of the ignition chamber exceeds the predetermined termperature;

(d) means for determining a first current loss by comparing the current through said first igniting means to a first predetermined current level and determining whether said first igniting means has failed based on the comparison;

(e) means for switching from said first igniting means to a second igniting means and providing current to the second igniting means provided in the ignition chamber when said first igniting means fails;

(f) a second current sense relay for monitoring flow of the current through said second igniting means;

(g) means for determining a second current loss by comparing the current through said second igniting means to a second predetermined current level and determining whether said second igniting means has failed based on the comparison; and (h) control means for providing an alarm and shutting off flow of said gas in said semiconductor wafer fabrication furnace based on the temperature signal or when said second igniting means fails.

2. An apparatus for controlling the burn-off operation of a gas in a semiconductor wafer fabrication furnace as recited in claim 1, wherein said gas includes hydrogen.

3. An apparatus for controlling the burn-off operation of a gas in a semiconductor wafer fabrication furnace as recited in claim 1, wherein said control means includes an audible alarm.

4. An apparatus for controlling the burn-off operation of a gas in a semiconductor wafer fabrication furnace as recited in claim 1, wherein said means for monitoring temperature includes a visual display device.

* * * * *